United States Patent [19]

Derrick

[11] 4,027,741

[45] June 7, 1977

[54] LOCKING HINGE MECHANISM FOR A STEPLADDER

[75] Inventor: Danny O. Derrick, Columbia, S.C.

[73] Assignee: Shakespeare Company, Columbia, S.C.

[22] Filed: July 15, 1976

[21] Appl. No.: 705,478

[52] U.S. Cl. ..... 182/22; 16/171

[51] Int. Cl.[2] ..... E06C 1/12

[58] Field of Search ..... 182/22, 21, 165; 16/171, 172, 177

[56] References Cited

UNITED STATES PATENTS

| | | | |
|---|---|---|---|
| 1,050,273 | 1/1913 | Hattenback | 182/22 |
| 1,549,696 | 8/1925 | Wernli | 182/22 |
| 1,579,701 | 4/1926 | Givens | 182/26 |
| 2,133,003 | 10/1938 | Webster | 182/22 |

*Primary Examiner*—Reinaldo P. Machado
*Attorney, Agent, or Firm*—Hamilton, Renner & Kenner

[57] ABSTRACT

Hinge mechanism for locking the two foldable sections of an extension stepladder in spread-apart position. Each section has a locking pin and slot at its upper end for interlocking with a complementary slot and pin on the other section when the sections are swung apart on one of said pins as a pivot, the pin and slot on one section being disengageable from the slot and pin on the other section by relative longitudinal movement of the sections when the sections are folded together.

12 Claims, 13 Drawing Figures

FIG. 12
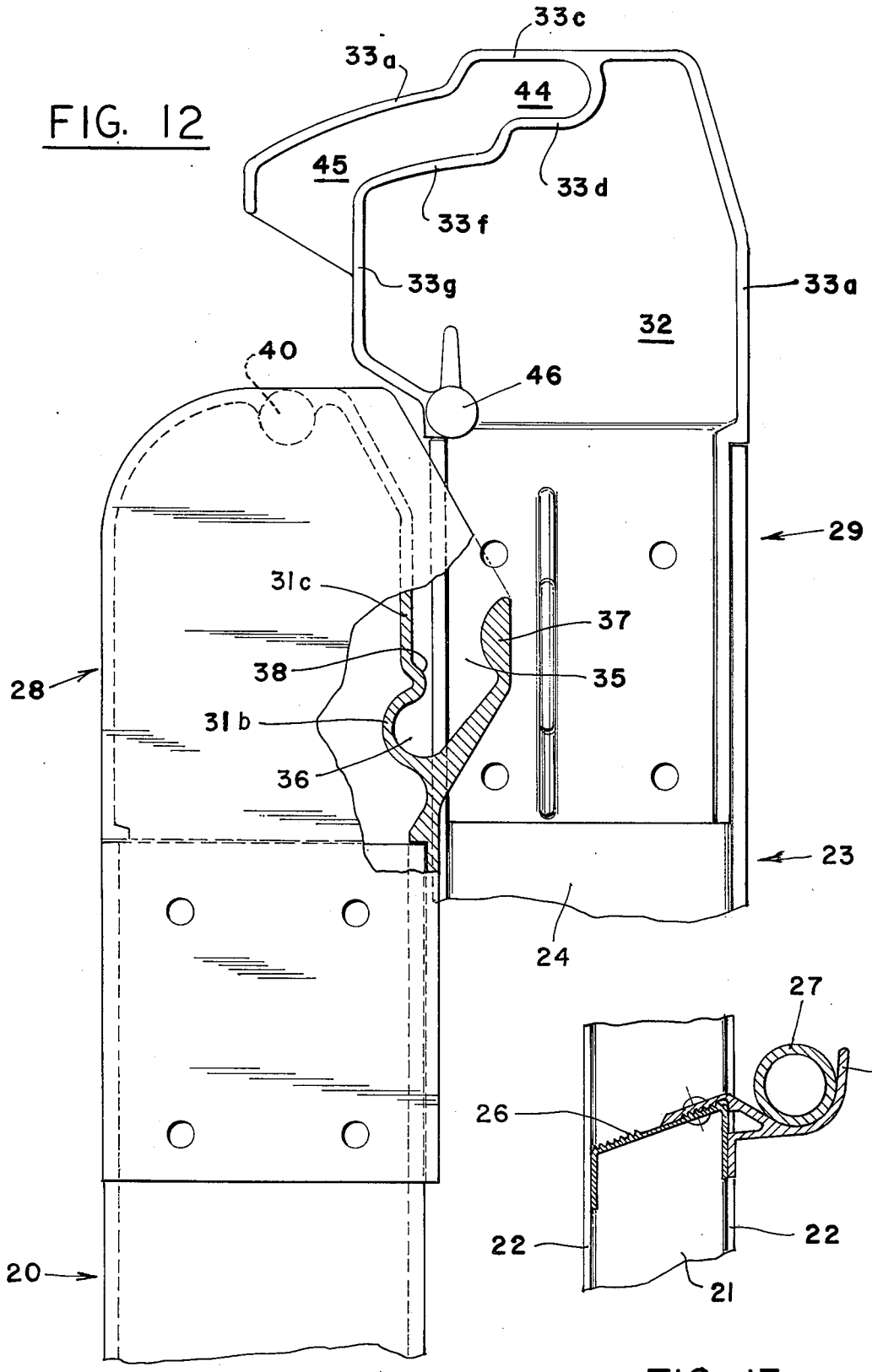
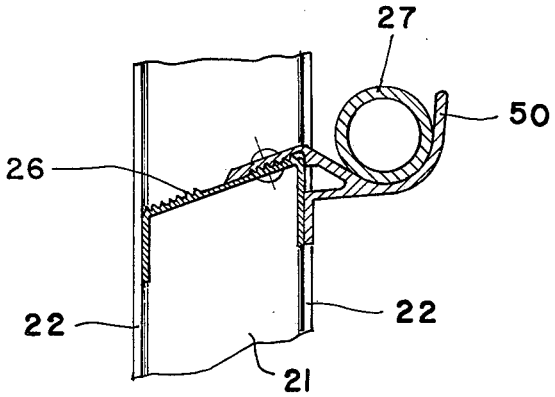
FIG. 13

LOCKING HINGE MECHANISM FOR A STEPLADDER

BACKGROUND OF THE INVENTION

Conventional stepladders having two foldable sections hinged together at the top are usually somewhat unstable in spread-apart position when a person is working and moving about on the ladder, as the sections have a tendency to fold or walk toward closed position. Prior mechanisms for correcting this tendency and stabilizing the stepladder in spread-apart position have included costly and complicated linkages and slide arrangements which are frequently ineffective and sometimes dangerous.

The same difficulties have been experienced with extension stepladders wherein one of the two sections may optionally be extended for using the ladder as an extension ladder by leaning the extended section against a wall or the like, with the added complication that not only must the hinge mechanism permit the extension, but the stabilizing mechanism for the stepladder use must not interfere with extension ladder use.

SUMMARY OF THE INVENTION

The present invention provides an improved simple and economical stabilizing mechanism which positively locks the sections of an extension stepladder in spread-apart position when used as a stepladder and also permits easy extension and retraction of one section and safe use as an extension ladder.

Another object is to provide a novel and improved hinge mechanism for pivoting the two sections at their upper ends, said mechanism embodying interlocking means to hold the sections in spread-apart position when scaled from front or rear.

A further object is to provide a novel and improved hinge mechanism for the two sections of an extension stepladder which facilitates extension movement of one of said sections when the sections are in closed or folded position while embodying interlocking means to hold the sections in spread-apart position when used as a stepladder.

These and other objects are accomplished by the improvements comprising the present invention, a preferred embodiment of which is shown by way of example in the accompanying drawings and described in detail in the following specification. Various modifications and changes in details of construction are comprehended within the scope of the appended claims.

BRIEF DESCRIPTION OF THE DRAWINGS

FIG. 12 is a view similar to FIG. 9 showing the fly section extended for use as an extension ladder.

FIG. 13 is a sectional view on line 13—13 of FIG. 2 showing additional means for supporting the fly section in extended position.

DESCRIPTION OF A PREFERRED EMBODIMENT

Figure 1:
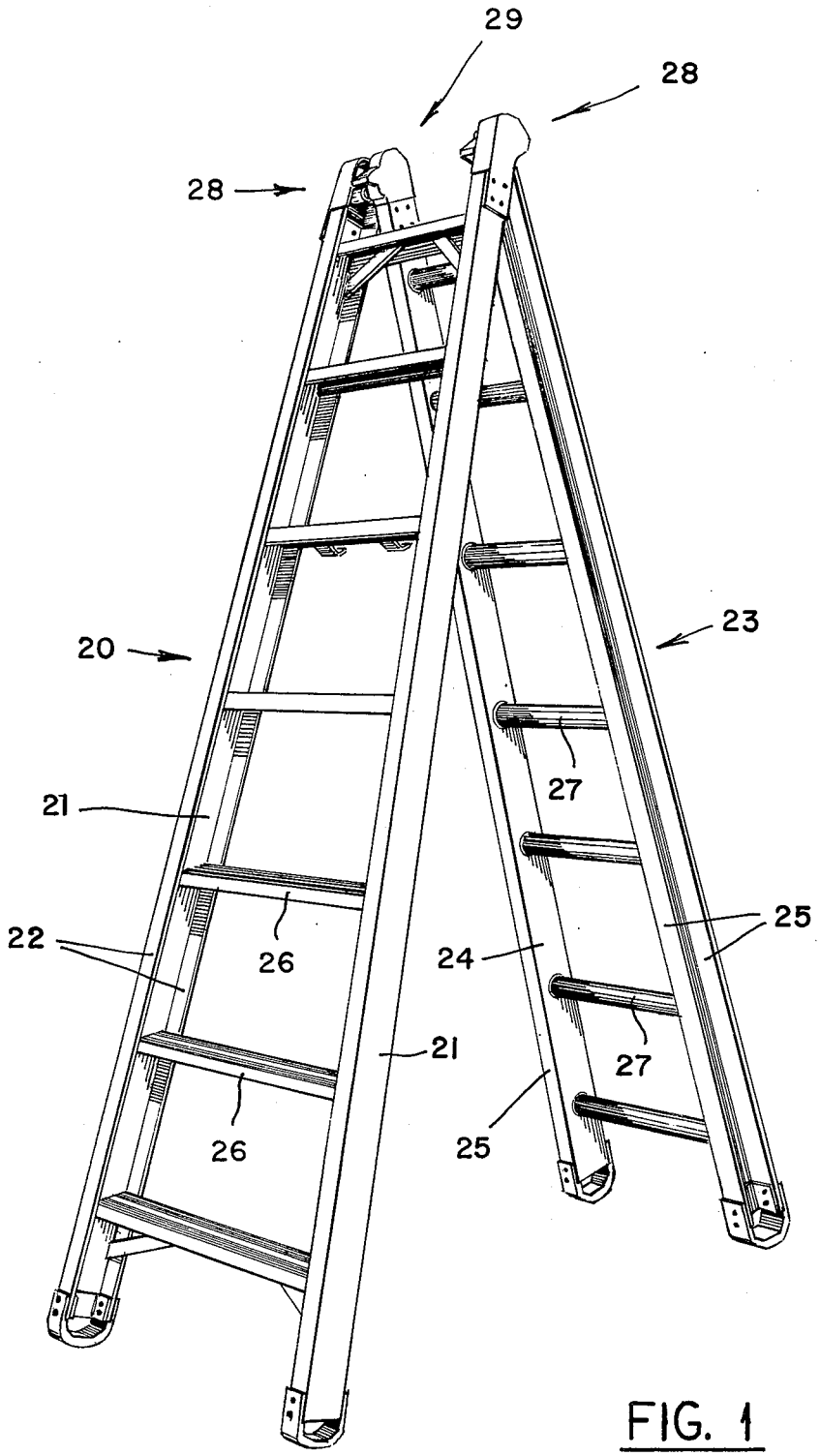
FIG. 1 is a front perspective view of a preferred embodiment of an extension stepladder embodying the improved hinge mechanism, with the sections in spread-apart position for stepladder use.

The improved locking hinge mechanism is shown in the drawings as applied to an extension stepladder which is readily adapted either for use as a stepladder or as an extension ladder, but it will be understood that the locking hinge mechanism is applicable to a stepladder without the extension feature.

Figure 2:
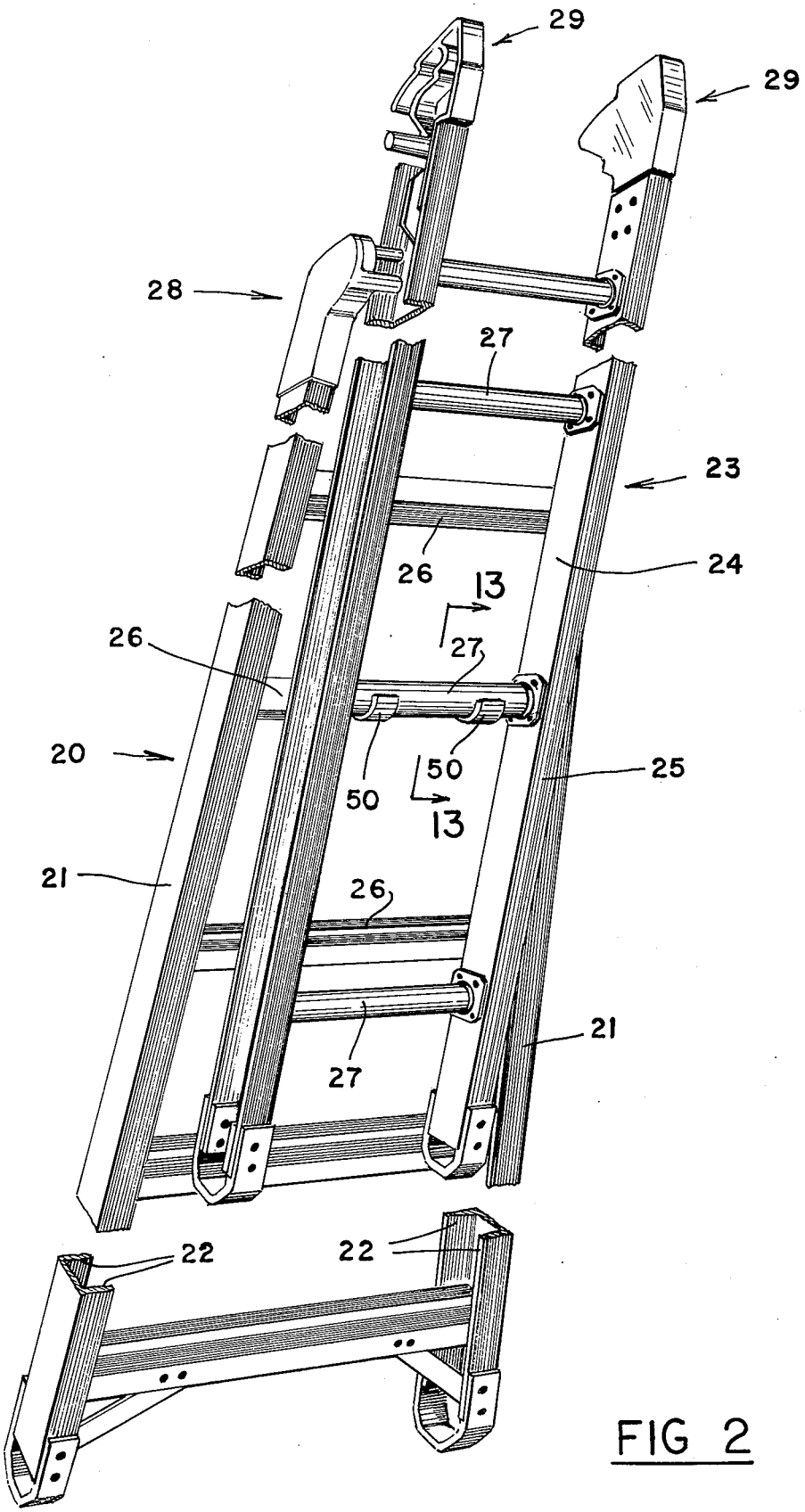
FIG. 2 is a front perspective view showing the ladder with the rear or fly section extended for use as an extension ladder.
Figure 4:
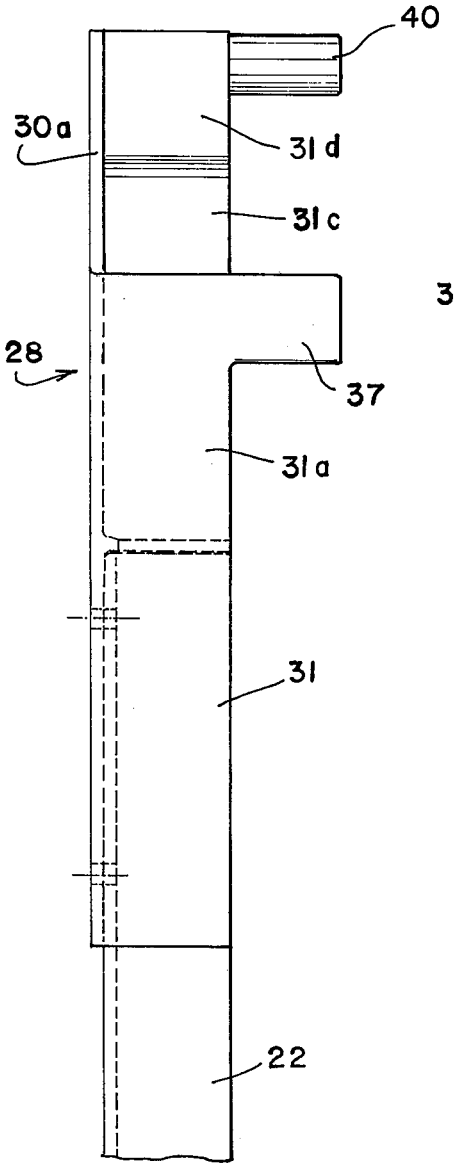
FIG. 4 is a side elevation thereof.
Figure 9:
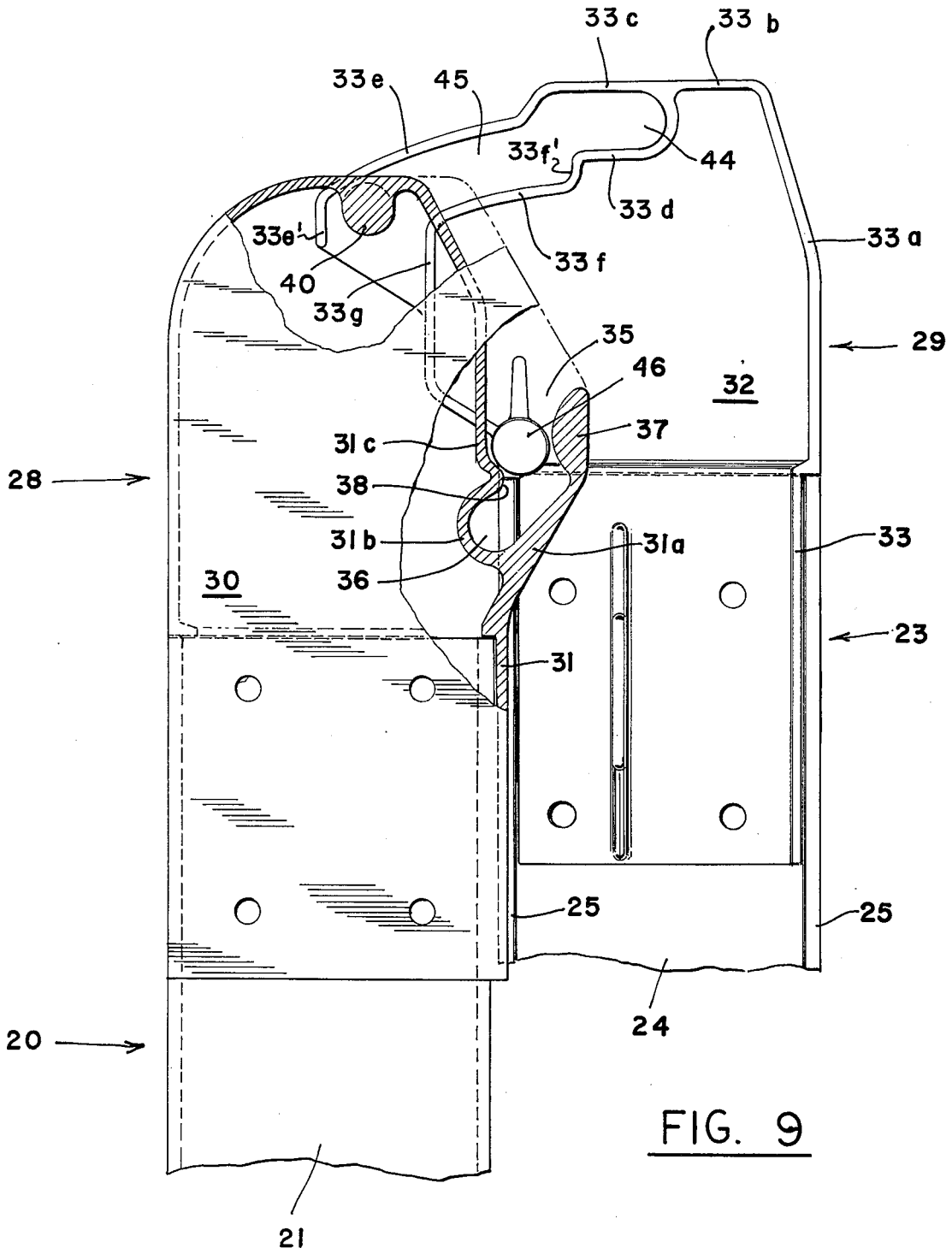
FIG. 9 is an elevation of the two hinge elements hinged together in the folded or closed position of the ladder, parts being broken away and in section.
Figure 11:
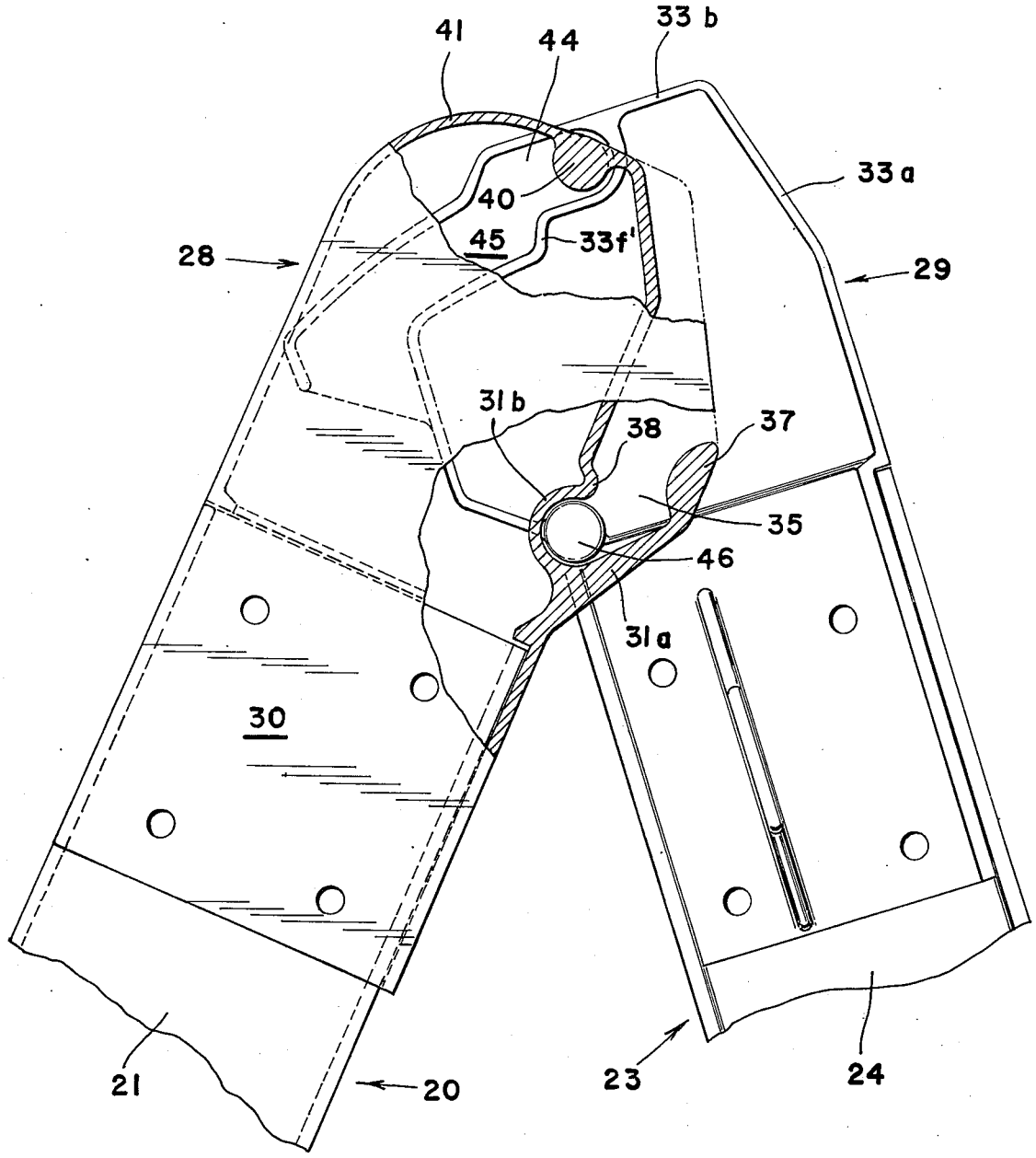
FIG. 11 is a similar view showing the two hinge elements in full spread-apart position.

FIGS. 1 and 11 show the two sections of an extension ladder locked in spread-apart position, and FIG. 9 shows the hinge elements of the two sections folded together. FIG. 2 shows the fly section in an extended position and FIG. 12 shows the longitudinal separation of the two sections, starting from the folded position.

The front or base section indicated generally at 20 has channel side rails 21 with their legs 22 facing inwardly, and the rear or fly section indicated generally at 23 has channel side rails 24 with their legs 25 facing outwardly. The base section 20 preferably has angular flat-topped rungs 26 extending between the webs of side rails 21, and the fly section has round or cylindrical rungs 27 extending between the webs of side rails 24.

Figure 3:
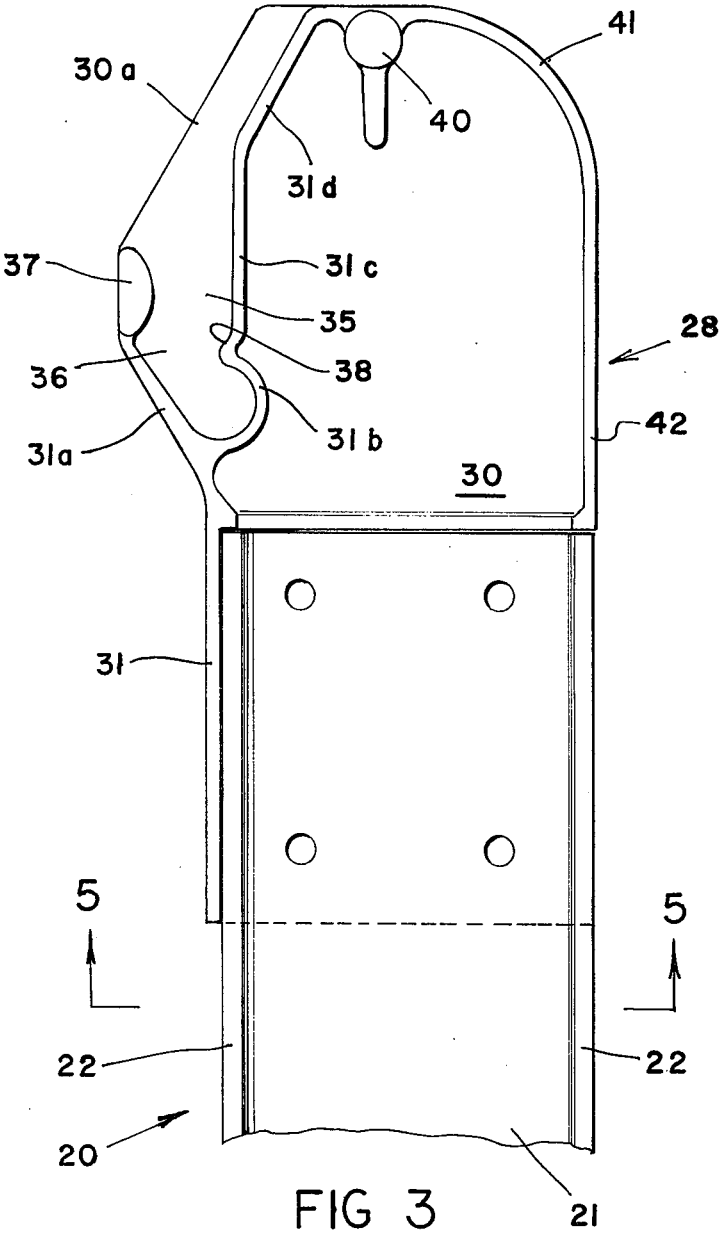
FIG. 3 is an enlarged elevation of the inner face of one hinge element secured to the upper end of the side rail of the front or base section.
Figure 5:
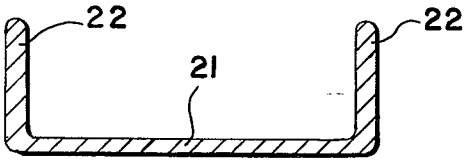
FIG. 5 is a sectional view on line 5—5 of FIG. 3.
Figure 7:
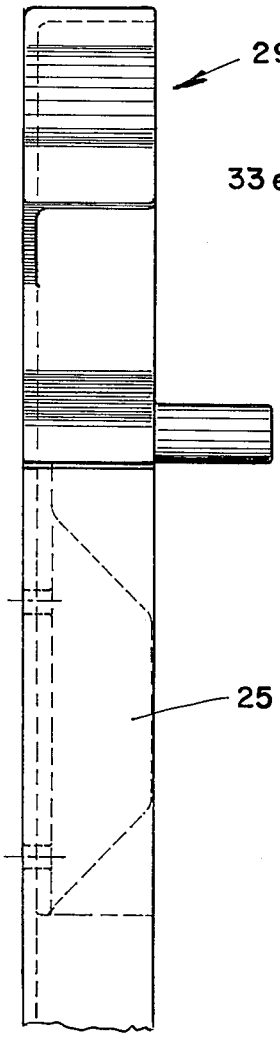
FIG. 7 is a side elevation thereof.
Figure 6:
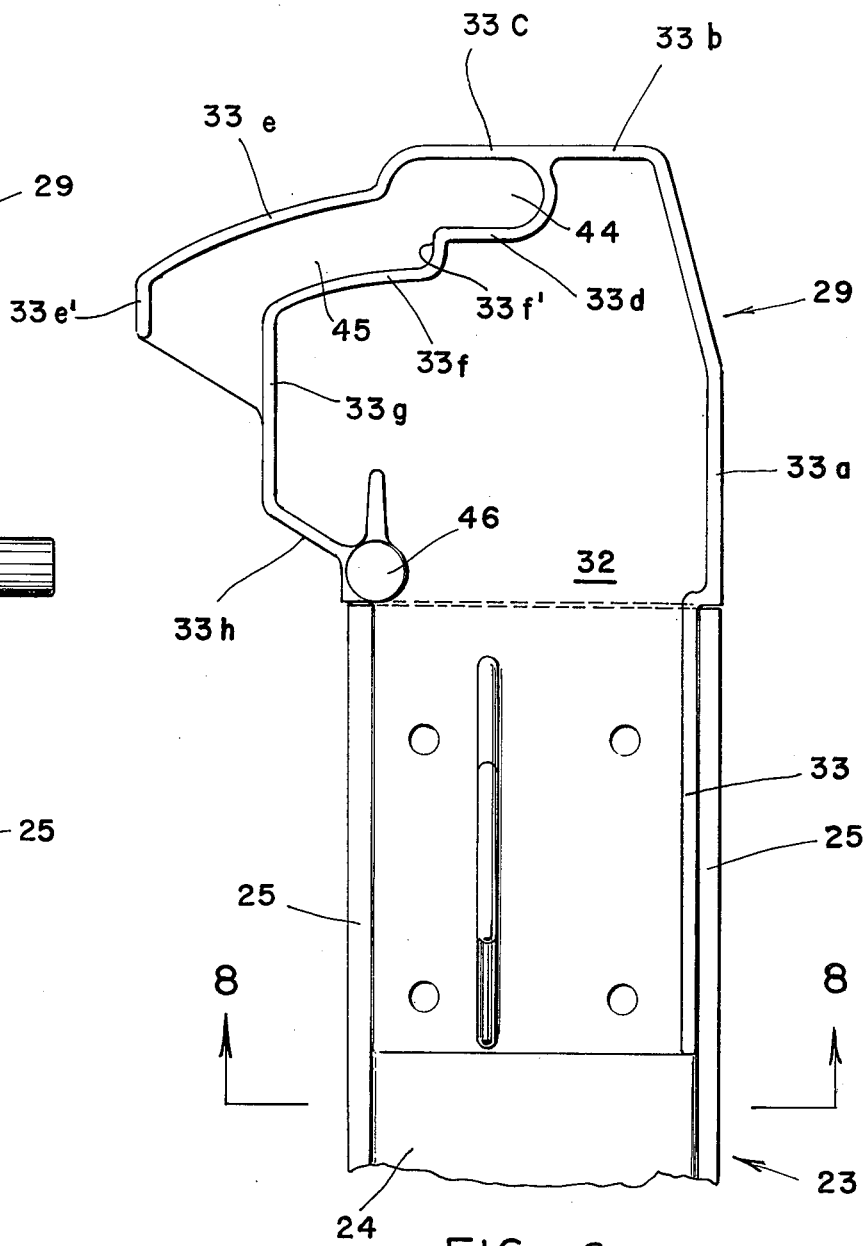
FIG. 6 is an enlarged elevation of the complementary hinge element secured to the upper end of the side rail of the fly section.
Figure 8:
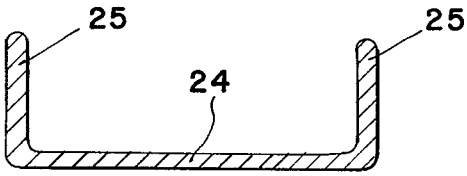
FIG. 8 is a sectional view on line 8—8 of FIG. 6.

Each side rail 21 has a hinge member indicated generally at 28 secured to its upper end, and each side rail 24 has a hinge member indicated generally at 29 secured to its upper end. As shown in FIG. 3, each hinge member 28 may have a web portion 30 secured to the web of a side rail 21 and a marginal side flange 31 within which one leg 22 of rail 21 fits. As shown in FIG. 6, each hinge member 29 may have a web portion 32 secured to the web of a side rail 24, and a marginal side flange 33 fitting within one leg 25 of rail 24.

The web 30 extends above the top of each side rail 21 and the side flange 31 of attached hinge member 28 extends upwardly and diverges into two flanges **31*a* and 31*b*, thus forming the closed lower end of an upwardly open slot 35 having its lower portion 36 inclined to the left. At the upper end of portion 36 flange 31*a* merges into and terminates at a rounded keeper pin 37 extending inwardly at right angles to the web 30, and opposite the pin 37 flange 31*b* is connected by a rounded nib or abutment 38 to the upwardly extending flange 31*c*, the upper portion 31*d* of which inclines to the right and is parallel to the marginal left edge 30*a*** of the web.

At the top of the web the flange **31*d* merges into a cylindrical pin 40 extending inwardly at right angles to the web 30, and continues from pin 40 in a downwardly curved portion 41 which merges into a straight downwardly extending flange 42 along the marginal right edge of the web and terminating at the top of side rail 21. Thus, the flange 31*a* and keeper pin 37 together with flanges 31*b* and 31*c* form the upwardly open slot 35 which terminates at the top of keeper pin 31, and the flange 31*b* continues upward into flanges 31*c*** and 31*d* forming a continuous guide flange leading downwardly into the slot.

The web 32 of hinge member 29 extends above the top of side rail 24, and a marginal flange 33*a* extends upwardly along the right edge of the web and then inclines slightly to the left to connect with a top marginal flange 33*b* which diverges into upper flange 33*c* and lower flange 33*d* forming the closed end of a horizontal slot portion 44 which is upwardly offset from a slot portion 45 continuing to the left and formed by an upper curved marginal flange portion 33*e* and a lower flange 33*f* which extends downwardly from flange 33*d* to form a shoulder 33*f'* and then to the left. The flange 33*e* has a downturned end portion 33*e'* and opposite thereto the flange 33*f* is connected to a downwardly extending flange 33*g* which has a lower inclined portion 33*h* terminating at a pin 46 extending at right angles to the web 32 at the top left corner of the rail 24 connected thereto. Thus, the slot 45 opens downwardly between the end flange 33*e'* and the flange 33*g*, and the web 32 is extended to connect said flanges and form the bottom wall of the slot.

As shown in FIG. 9, when the front and rear sections 20 and 23 are folded together with the hinge members 28 and 29 connected, the pin 46 of each member 29 is received in the slot 35 of the adjoining member 28 between the abutment nib 38 and the keeper pin 37, and the pin 40 of member 28 is received in the entrance opening of slot 45 of member 29. To open or spread apart the sections, the front section 20 is held in vertical position and the bottom of the rear section 23 is swung outwardly therefrom, rotating the pin 46 on the nib 38 and the pin 40 moves in slot 45 into abutment with shoulder 33*f'*, to the position shown in FIG. 10.

In this position the rear section 23 can be released and as the front section 20 is tilted forwardly the rear section will drop by gravity until the upper closed end of its offset slot 44 abuts pin 40 and its pin 46 abuts the lower closed end of offset slot 36 in member 30. This position is shown in FIGS. 1 and 11 with the bottoms of both sections resting on the ground or other horizontal support, and the pin and slot means of each hinge member 28 are interlocked with the complementary slot and pin means of the adjoining hinge member 29. It will be apparent from FIG. 11 that either the front or rear sections of the ladder may be scaled because the pins on each member 28 and 29 will be forced into interlocking engagement with the closed ends of the slots in the complementary member in either case.

Figure 10:
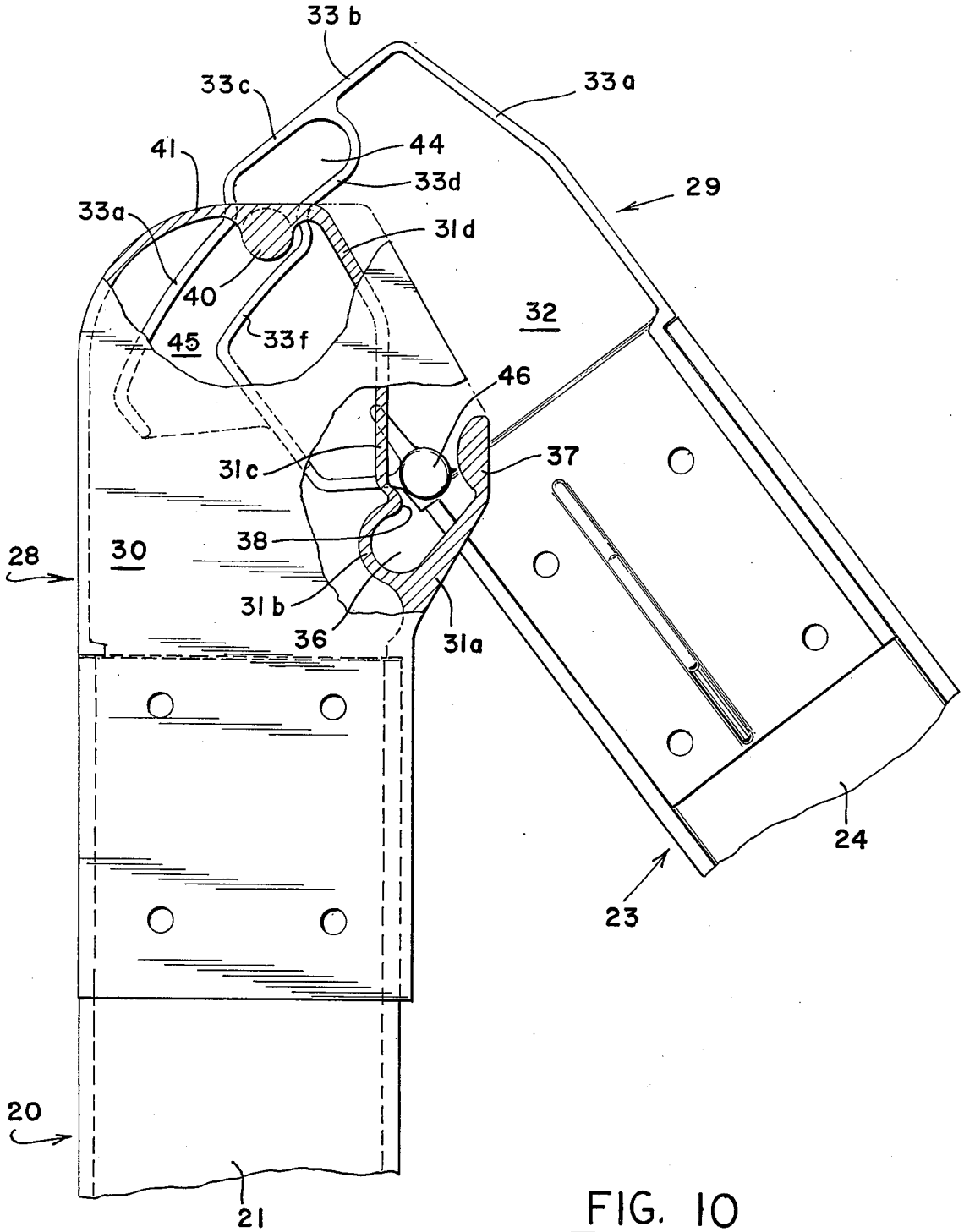
FIG. 10 is a similar view showing the two hinge elements in partially spread-apart position.

In order to again close the ladder to the folded position of FIG. 9, the front section 20 is tilted rearwardly to a substantially vertical position, and the rear section 23 is lifted upwardly to the position of FIG. 10, after which the rear section is swung forwardly, causing pin 46 to rotate against nib 38 and pin 40 to slide downwardly in slot 45 to the position of FIG. 9.

When it is desired to use the ladder as an extension ladder, the sections are placed in the folded position of FIG. 9, and the rear section 23 is slid straight upwardly as indicated in FIG. 12. This moves the open end of slot 45 of member 29 above and clear of the pin 40 of member 28 and moves the pin 46 of member 29 out of and above slot 35 of member 28. Continued upward movement of rear section 23 will extend the ladder to the desired position so that the upper end of the rear section can be leaned against a wall or other support. In extended position the keeper pins 37 on the front section 28 will project behind the adjacent channel flanges 25 of the side rails 24 of the rear section to prevent separation of the rear section from the upper end of the front section.

As shown in FIGS. 2 and 13, one of the rungs 26 of section 28 has secured thereon a pair of hooks 50 for engaging under and around any one of the rungs 27 to prevent separation of the lower part of the rear section 29 and support it in extended position. To retract the rear section to folded position, the rear section is lifted slightly to raise the engaged rung 27 above the hooks 50, whereupon the lower part of the rear section can be swung rearwardly to clear the hooks and the section allowed to slide downwardly to the position of FIG. 9.

It will be apparent that an improved locking hinge mechanism has been provided for an extension stepladder which provides an extremely stable interlocking connection when the front and rear sections are spread apart for use as a stepladder, and permits easy extension of the rear section from folded position for use as an extension ladder. Moverover, folding and unfolding the ladder is a quick and easy operation.

I claim:

1. Hinge mechanism for a stepladder having front and rear sections hinged together at one end, comprising first pin and slot means on the upper end of one section engaging complementary slot and pin means on the upper end of the other section for hinging movement of said sections, said first and said complementary pin and slot means interlocking with each other to hold the sections in spread-apart relation and being disengageable by relative longitudinal movement of said sections to slide the pins out of the slots when the sections are folded together.

2. Hinge mechanism as described in claim 1, wherein the slot means on one section opens upwardly and the slot means on the other section opens downwardly.

3. Hinge mechanism as described in claim 1, wherein the pin means on one section rotatably engages a rounded abutment in the slot means on the other section during hinging movement of said sections.

4. Hinge mechanism as described in claim 2, wherein the pin means on one section rotatably engages a rounded abutment in the slot means on the other section during hinging movement of said sections.

5. Hinge mechanism as described in claim 1, wherein each of said slot means have closed offset end portions for interlocking with the pin means of the other section in the full spread-apart position of said sections.

6. Hinge mechanism as described in claim 2, wherein each of said slot means have closed offset end portions for interlocking with the pin means of the other section in the full spread-apart position of said sections.

7. Hinge mechanism as described in claim 1, wherein the front and rear sections have channel side rails, and one of said sections has a keeper pin extending into the channel side rail of the other section when the sections are folded together.

8. Hinge mechanism as described in claim 7, wherein the keeper pin is located on one side of the slot means on said one section and the pin means on the other section rotatably engages said keeper pin during hinging movement of the sections.

9. Hinge mechanism as described in claim 7, wherein a rounded abutment in said slot means on said one section opposite to said keeper pin rotatably engages said pin means on the other section.

10. Hinge mechanism as described in claim 9, wherein the slot means on said one section has a closed offset end portion adjacent said rounded abutment and said keeper pin for receiving the pin means on the other section when the sections are in full spread-apart position.

11. Hinge mechanism as described in claim 10, wherein the slot means on the other section has a closed offset end portion for receiving the pin means on said one section when the sections are in full spread-apart position.

12. Hinge mechanism as described in claim 11, wherein the slot means on said one section extends longitudinally thereof and is open at its upper end, and the slot means on said other section extends laterally thereof and is downwardly open at its outer end.

* * * * *